US011258174B2

(12) United States Patent
Kim et al.

(10) Patent No.: US 11,258,174 B2
(45) Date of Patent: Feb. 22, 2022

(54) ANTENNA RADIATOR INCLUDING PLURALITY OF LAYERS AND ELECTRONIC DEVICE INCLUDING THE SAME

(71) Applicant: Samsung Electronics Co., Ltd., Gyeonggi-do (KR)

(72) Inventors: Yoonjung Kim, Gyeonggi-do (KR); Jaedeok Lim, Gyeonggi-do (KR); Gyuyeong Cho, Gyeonggi-do (KR); Hyein Park, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 16/861,415

(22) Filed: Apr. 29, 2020

(65) Prior Publication Data

US 2020/0350682 A1 Nov. 5, 2020

(30) Foreign Application Priority Data

Apr. 30, 2019 (KR) ..... 10-2019-0050482

(51) Int. Cl.
*H01Q 1/24* (2006.01)
*H01Q 9/04* (2006.01)

(52) U.S. Cl.
CPC ..... *H01Q 9/0414* (2013.01); *H01Q 1/243* (2013.01)

(58) Field of Classification Search
CPC ..... H01G 9/0414; H01G 1/243
See application file for complete search history.

(56) References Cited

U.S. PATENT DOCUMENTS

| | | | | |
|---|---|---|---|---|
| 6,223,033 | B1 | 4/2001 | Lusterman | |
| 9,246,208 | B2 | 1/2016 | Qu et al. | |
| 10,707,571 | B2 | 7/2020 | Wu | |
| 2004/0051666 | A1* | 3/2004 | Aisenbrey | H05K 3/101 343/700 MS |
| 2004/0233112 | A1 | 11/2004 | Aisenbrey | |
| 2010/0097273 | A1 | 4/2010 | Biris et al. | |
| 2015/0278671 | A1 | 10/2015 | Martin et al. | |

(Continued)

FOREIGN PATENT DOCUMENTS

| | | | |
|---|---|---|---|
| JP | 2017-208665 | A | 11/2017 |
| KR | 10-2011-0080023 | A | 7/2011 |
| KR | 10-2018-0024583 | A | 3/2018 |

OTHER PUBLICATIONS

Elliot, et al.; "E-textile Microstrip Patch Antennas for GPS"; Apr. 23, 2012; XP032200215.

(Continued)

*Primary Examiner* — Graham P Smith
(74) *Attorney, Agent, or Firm* — Cha & Reiter, LLC

(57) ABSTRACT

Disclosed is an electronic device including a housing, a first plate positioned on a front surface of the housing, a second plate positioned on a rear surface of the housing, an antenna radiator interposed between the first plate and the second plate, and a wireless communication circuit connected to the antenna radiator and processing a signal in a specific frequency band. The antenna radiator includes at least one conductive fabric layer having a resistance characteristic suitable for transmitting or receiving the signal in the specific frequency band, and the at least one conductive fabric layer includes a fabric that is plated with at least one metal.

20 Claims, 20 Drawing Sheets

(56) References Cited

U.S. PATENT DOCUMENTS

| | | | |
|---|---|---|---|
| 2016/0154983 | A1 | 6/2016 | Qu et al. |
| 2018/0145405 | A1 | 5/2018 | Wu |
| 2019/0181558 | A1 | 6/2019 | Kakuya et al. |
| 2019/0221919 | A1 | 7/2019 | Koo et al. |

OTHER PUBLICATIONS

International Search Report dated Aug. 21, 2020.
European Search Report dated Sep. 22, 2020.

* cited by examiner

ANTENNA RADIATOR INCLUDING PLURALITY OF LAYERS AND ELECTRONIC DEVICE INCLUDING THE SAME

CROSS-REFERENCE TO RELATED APPLICATION(S)

This application is based on and claims priority under 35 U.S.C. § 119 to Korean Patent Application No. 10-2019-0050482, filed on Apr. 30, 2019, in the Korean Intellectual Property Office, the disclosure of which is incorporated by reference herein its entirety.

BACKGROUND

1. Field

One or more embodiments of the disclosure generally relate to an antenna radiator in the form of a film that includes a plurality of layers.

2. Description of Related Art

With the development of mobile communication technologies, electronic devices can now be configured to freely connect to wireless/wired networks and be easily portable. For example, because portable electronic devices such as smartphones, tablet PCs, or the like include antennas for transmitting and receiving wireless signals, these portable electronic devices may connect to wireless communication networks.

The electronic device may include an antenna for transmitting and receiving signals in various frequency bands. With the development of wireless communication technology, the frequencies used in wireless communication and the corresponding range of frequency bandwidths have increased, and the number of antennas in the device is increasing to correspond to the increased frequency band range. However, because it is generally desirable for the electronic device to be as small and lightweight as possible so that it is more portable, the space in which the antenna may be mounted is decreasing.

The above information is presented as background information only to assist with an understanding of the disclosure. No determination has been made, and no assertion is made, as to whether any of the above might be applicable as prior art with regard to the disclosure.

SUMMARY

In an electronic device, an antenna in the form of a flexible printed circuit board (FPCB) may be mounted in order to implement the antenna in a limited antenna mounting space. In this case, the FPCB antenna may not use the whole attachment area as the antenna pattern space. Furthermore, the performance of the FPCB antenna may degrade over time as attachment of its curved portion may degrade over time.

In accordance with an aspect of the disclosure, an electronic device may include a housing, a first plate positioned on a front surface of the housing, a second plate positioned on a rear surface of the housing, an antenna radiator interposed between the first plate and the second plate, and a wireless communication circuit connected to the antenna radiator and processing a signal in a specific frequency band. The antenna radiator may include at least one conductive fabric layer having a resistance characteristic suitable for transmitting or receiving the signal in the specific frequency band, and the at least one conductive fabric layer may include a fabric that is plated with at least one metal.

In accordance with another aspect of the disclosure, an antenna radiator may include at least one conductive fabric layer including a fabric that is plated with at least one metal and a conductive coating layer stacked on the at least one conductive fabric layer, and configured to prevent corrosion of the at least one conductive fabric layer and transmit an electrical signal external to the antenna radiator to the at least one conductive fabric layer.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Hereinafter, various embodiments of the disclosure may be described with reference to accompanying drawings. Accordingly, those of ordinary skill in the art will recognize that modification, equivalent, and/or alternative on the various embodiments described herein can be variously made without departing from the scope and spirit of the disclosure.

Figure 1:
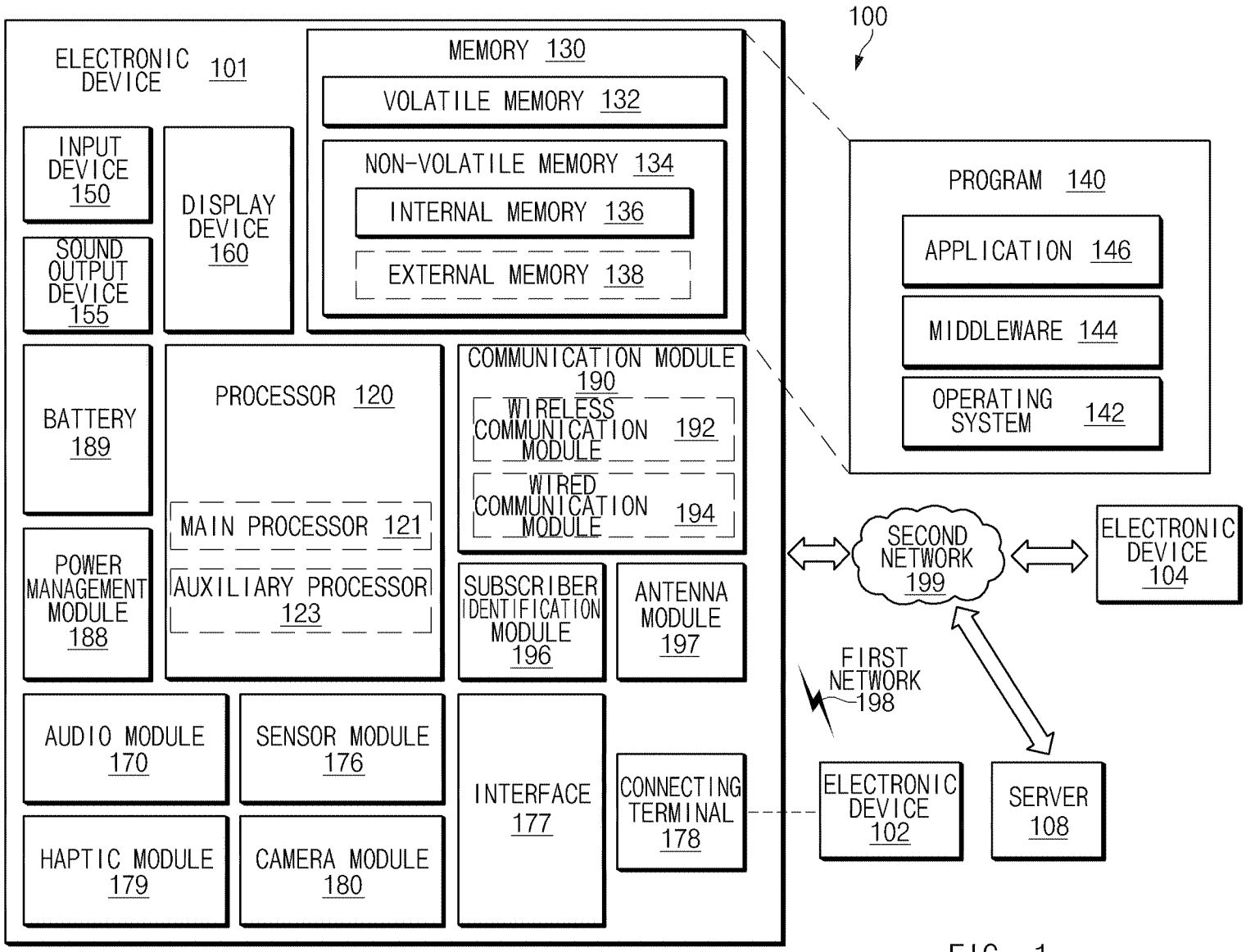
FIG. 1 is a block diagram illustrating an electronic device in a network environment according to various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in nonvolatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the nonvolatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Aspects of the disclosure are to address at least the above-mentioned problems and/or disadvantages and to provide at least the advantages described below. Accordingly, an aspect of the disclosure is to provide an antenna structure that maintains constant performance in a limited antenna space. Such an antenna includes an antenna element (e.g., a film-type radiator) formed using a fabric and a conductive member.

Figure 2:
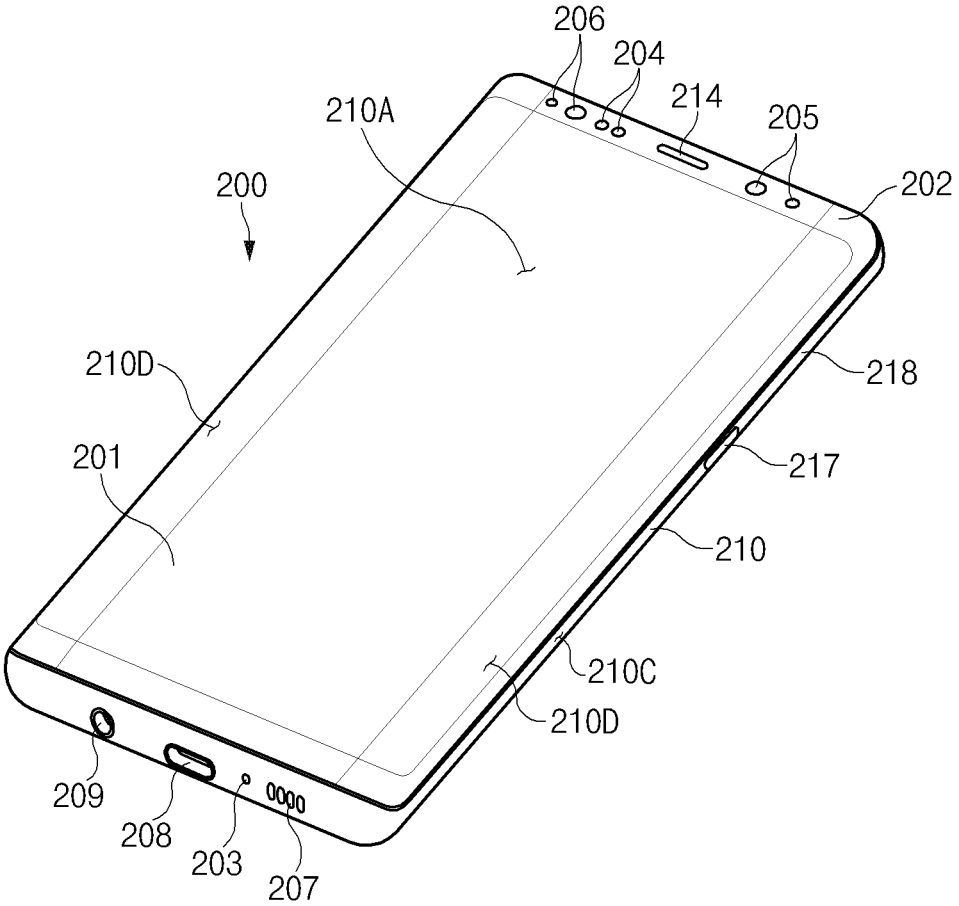
FIG. 2 is a front perspective view of a mobile electronic device according to an embodiment.
Figure 3:
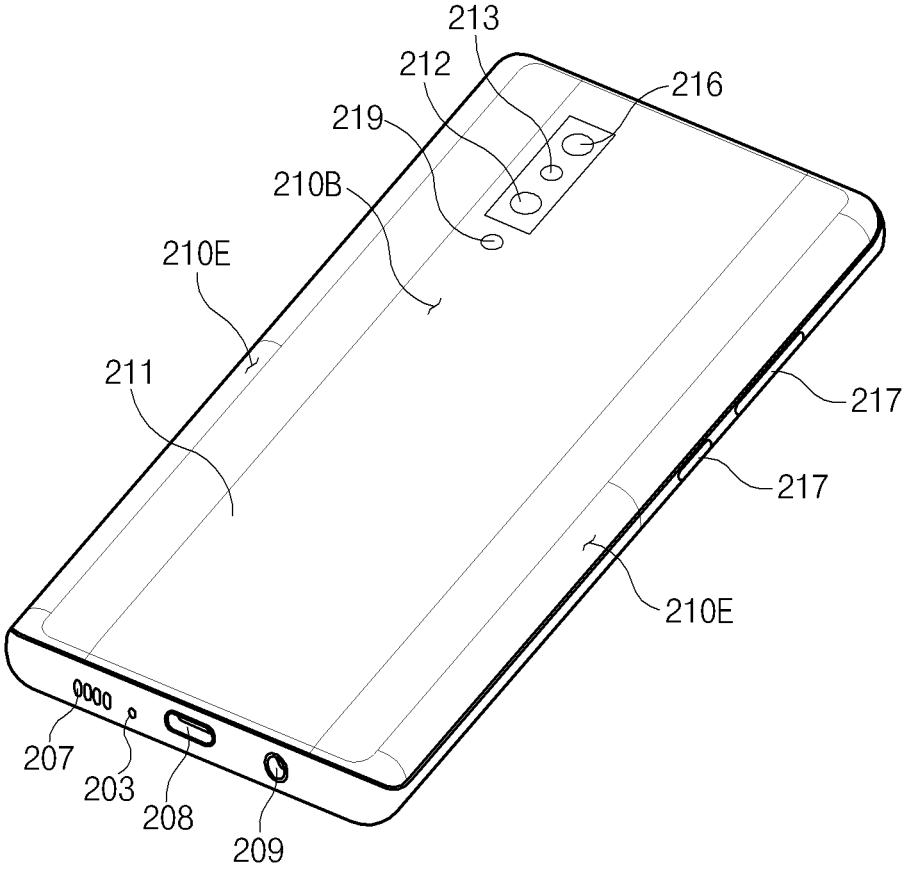
FIG. 3 is a rear perspective view of the electronic device of FIG. 2.

FIG. 2 is a front perspective view of a mobile electronic device according to an embodiment. FIG. 3 is a rear perspective view of the electronic device of FIG. 2.

Referring to FIGS. 2 and 3, an electronic device 200 according to an embodiment may include a housing 210 that includes a first surface (or a front surface) 210A, a second surface (or a rear surface) 210B, and a side surface 210C surrounding the space between the first surface 210A and the second surface 210B. In another embodiment (not illustrated), the housing may refer to a structure that forms a part or all of the first surface 210A, the second surface 210B, and the side surface 210C of FIG. 2. According to an embodiment, the first surface 210A may be implemented with a front plate 202 (e.g., a glass plate including various coating layers, or a polymer plate), at least a portion of which is substantially transparent. The second surface 210B may be implemented with a rear plate 211 that is substantially opaque. For example, the rear plate 211 may be implemented with coated or colored glass, ceramic, polymer, metal (e.g., aluminum, stainless steel (STS), or magnesium), or the combination of at least two of the materials. The side surface 210C may be coupled with the front plate 202 or the rear plate 211 and may be implemented with a side bezel structure (or a "side member") 218 that includes metal and/or polymer. For example, a portion of the side bezel structure 218 may be first made of polymer, and the metal portion may be partially bonded to the polymer. In an embodiment, the rear plate 211 and the side bezel structure 218 may be integrally formed and may include the same material.

In the illustrated embodiment, the front plate 202 may include two first regions 210D that are bent toward the rear plate 211 but seamlessly extending from the opposite long edges of the first surface 210A. In the embodiment shown in FIG. 3, the rear plate 211 may include two second regions 210E that are bent toward the front plate 202 but seamlessly extending from the opposite long edges of the second surface 210B. In an embodiment, the front plate 202 (or the rear plate 211) may include only one of the first regions 210D (or the second regions 210E). In another embodiment, a portion of the first regions 210D or the second regions 210E may not be included. Accordingly, in this embodiment, when viewed from the side, the side bezel structure 218 may have a first thickness (or width) on a portion where the first regions 210D or the second regions 210E are not included, and may have a second thickness, which is smaller than the first thickness, on another portion where the first regions 210D or the second regions 210E are included.

According to an embodiment, the electronic device 200 may include at least one or more of a display 201, an audio module 203, 207, 214, a sensor module 204, 216, 219, a camera module 205, 212, 213, key input devices 217, a light-emitting device 206, and a connector hole 208, 209. In an embodiment, the electronic device 200 may not include at least one of the components, such as the key input devices 217 or the light-emitting device 206, or may further include some other components not listed above.

The display 201 may be exposed through the majority portion of the front plate 202, for example. In an embodiment, at least a portion of the display 201 may be exposed through the first surface 210A and the first regions 210D of the front plate 202. In an embodiment, corners of the display 201 may have shapes that are substantially identical to the shapes of the outer corners of the front plate 202 adjacent thereto. In another embodiment (not illustrated), to increase the area where the display 201 is exposed, the bezel between the outer edge of the display 201 and the outer edge of the front plate 202 may be minimized.

In another embodiment (not illustrated), a recess or an opening may be formed in a portion of the screen display region of the display 201, and at least one or more of the audio module 214, the sensor module 204, the camera module 205, and the light-emitting device 206 may be provided in the recess or the opening. In another embodiment (not illustrated), at least one or more of the audio module 214, the sensor module 204, the camera module 205, the fingerprint sensor 216, and the light-emitting device 206 may be provided behind the screen display region of the display 201. In yet another embodiment (not illustrated), the display 201 may be coupled to or disposed adjacent to a touch sensing circuit, a pressure sensor capable of measuring the intensity (or pressure) of the touch, and/or a digitizer capable of detecting a magnetic stylus pen. In an embodiment, at least a portion of the sensor module 204, 219 and/or at least a portion of the key input devices 217 may be disposed in the first regions 210D and/or the second regions 210E.

The audio module 203, 207, 214 may include a microphone hole 203 and a speaker hole 207, 214. A microphone for recording external sound may be disposed within the microphone hole 203. In an embodiment, a plurality of microphones may be disposed to enable detection of the direction of the sound. The speaker hole 207, 214 may include the external speaker hole 207 and the receiver hole 214, where the receiver hole 214 corresponds to a receiver used in phone calls. In an embodiment, the speaker hole 207, 214 and the microphone hole 203 may be implemented as a single hole, or a speaker (e.g., piezoelectric speaker) may be included without a corresponding speaker hole.

The sensor module 204, 216, 219 may generate electrical signals or data values corresponding to internal operation states of the electronic device 200 or some external environment state. The sensor module 204, 216, 219 may include, for example, a first sensor module 204 (e.g., a proximity sensor) and/or a second sensor module (not illustrated) (e.g., a fingerprint sensor) disposed on the first surface 210A of the housing 210, and/or a third sensor module 219 (e.g., a hear rate monitor (HRM) sensor) and/or a fourth sensor module 216 disposed on the second surface 210B of the housing 210. The fingerprint sensor may be positioned on the second surface 210B as well as the first surface 210A (e.g., the display 201) of the housing 210. The electronic device 200 may further include other sensor modules not illustrated, such as gesture sensor, gyro sensor, barometric pressure sensor, magnetic sensor, acceleration sensor, grip sensor, color sensor, infrared (IR) sensor, biometric sensor, temperature sensor, humidity sensor, illumination sensor, etc.

The camera module 205, 212, 213 may include a first camera device 205 positioned on the first surface 210A of the electronic device 200, and a second camera module 212 and/or a flash 213 positioned on the second surface 210B. The camera devices 205 and 212 may include one or more lenses, image sensor, and/or image signal processor. The flash 213 may include, for example, a light emitting diode or a xenon lamp. In an embodiment, two or more lenses (e.g., an infrared camera and wide-angle and telephoto lenses) and image sensors may be disposed on one surface of the electronic device 200.

The key input devices 217 may be disposed on the side surface 210C of the housing 210. In another embodiment, the electronic device 200 may not include physical keys, and the key input device not included may be implemented on the display 201 as a soft key.

The light-emitting device 206 may be disposed, for example, on the first surface 210A of the housing 210. The light-emitting device 206 may provide status information of the electronic device 200 by, for example, emitting light in a certain pattern. In another embodiment, the light-emitting device 206 may be used, for example, as a flash that operates in conjunction with the operation of the camera module 205. The light-emitting device 206 may include, for example, light-emitting diode (LED), IR LED, and xenon lamp.

The connector hole 208, 209 may include a first connector hole 208 that is capable of accommodating a connector (e.g., a USB connector) for transmitting/receiving power and/or data to/from an external electronic device, and/or a second connector hole (or an earphone jack) 209 that is capable of accommodating a connector for transmitting/receiving audio signals to/from the external electronic device.

Figure 4:
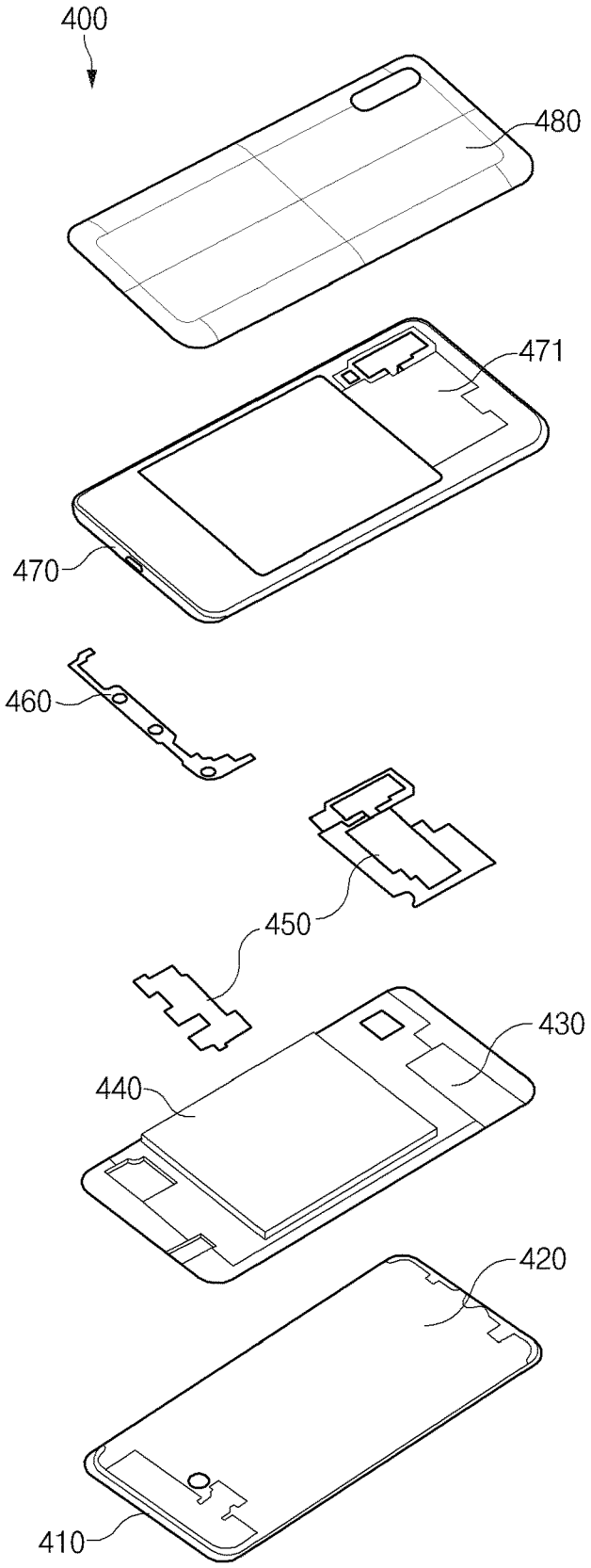
FIG. 4 is an exploded perspective view of an electronic device of FIG. 2.

FIG. 4 is an exploded perspective view of an electronic device of FIG. 2.

Referring to FIG. 4, the electronic device 400 (e.g., the electronic device 200) may include a front plate 410, a display 420, a first support member 430 (e.g., bracket), a battery 440, a printed circuit board 450, an antenna radiator 460 (e.g., an antenna element) in the form of a sheet or a film, a side bezel structure 470, a second support member 471 (e.g., a rear case), and/or a rear plate 480. In an embodiment, the electronic device 400 may not include at least one of the components, such as the first support member 430 or the second support member 471, or may further include some other component not shown. At least one of the components of the electronic device 400 may be identical or similar to at least one of the components of the electronic device 200 of FIG. 2 or 3, and thus, additional description will be omitted to avoid redundancy.

The display 420 may be coupled to one surface of the first support member 430, and the printed circuit board 450 may be coupled to an opposite surface of the first support member 430. The second support member 471 may be disposed within the electronic device 400, and the second support member 471 may be connected with the side bezel structure 470 or may be integrally formed with the side bezel structure 470. For example, the first support member 430 or the second support member 471 may be made of non-metal (e.g., polymer) material, or may be made of metal.

A processor, a memory, an interface, etc. may be mounted on the printed circuit board 450. For example, the processor may include one or more of a central processing unit, an application processor, a graphic processing device, an image signal processor, a sensor hub processor, or a communication processor.

The memory may include, for example, volatile memory or nonvolatile memory.

The interface may include, for example, high definition multimedia interface (HDMI), universal serial bus (USB) interface, secure digital (SD) card interface, and/or audio interface. The interface may allow electrical or physical connection between the electronic device 400 and an external electronic device and may include a USB connector, an SD card/MMC connector, or an audio connector.

The battery 440 supplies power to at least one component of the electronic device 400 may include, for example, a primary cell incapable of being recharged, a rechargeable secondary cell, and/or a fuel cell. At least part of the battery 440 may be disposed on substantially the same plane as the printed circuit board (PCB) 450, for example. The battery 440 may be integrally disposed within the electronic device 400, or may be disposed to be removable from the electronic device 400 by the end user of the electronic device 400.

The antenna radiator 460 may be disposed between the second support member 471 and the first support member 430. The antenna radiator 460 may be formed as a sheet or film including a plurality of layers. For example, the antenna radiator 460 may be included in a near field communication (NFC) antenna, an antenna for wireless charging, and/or a magnetic secure transmission (MST) antenna. In these examples, the antenna radiator 460 may perform short range communication with an external device or may wirelessly transmit/receive power to charge the battery 440. In another embodiment, an antenna structure may be implemented with a portion of the side bezel structure 470 and/or the second support member 471, or with a combination thereof. In yet another embodiment, the antenna radiator 460 may be interposed between the rear plate 480 and the second support member 471. According to an embodiment, the antenna radiator 460 may be included in an antenna as the antenna element together with a feed part and a ground part.

Figure 5A:
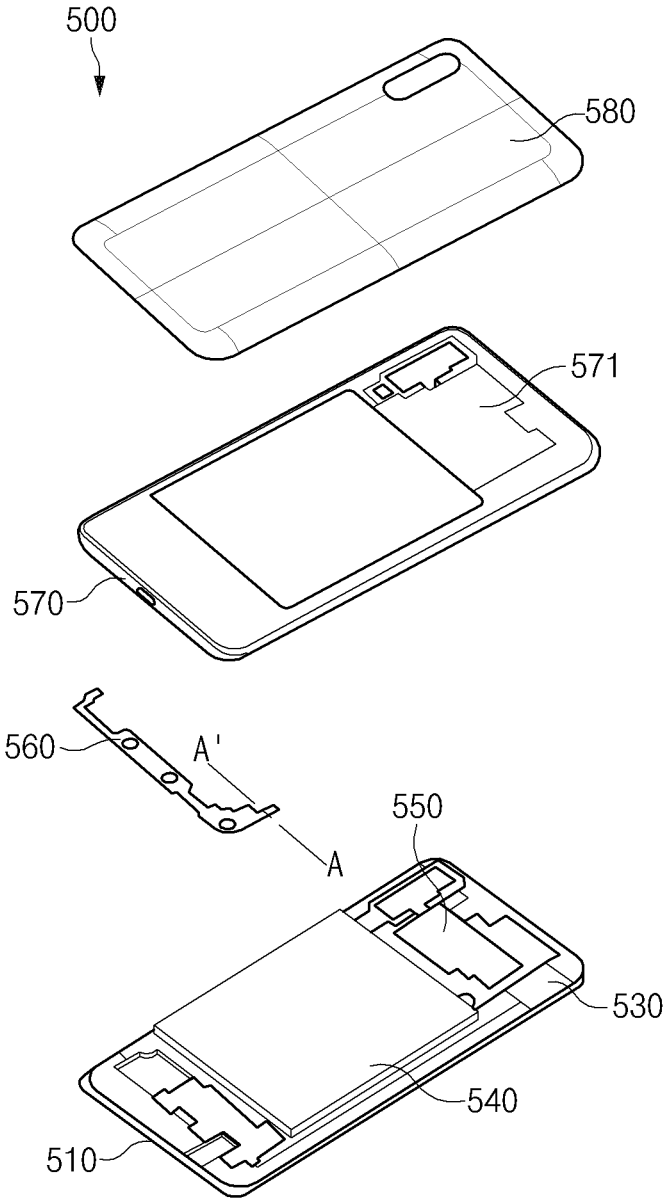
FIG. 5A is an exploded perspective view illustrating an antenna radiator positioned in an electronic device according to an embodiment.
Figure 5B:
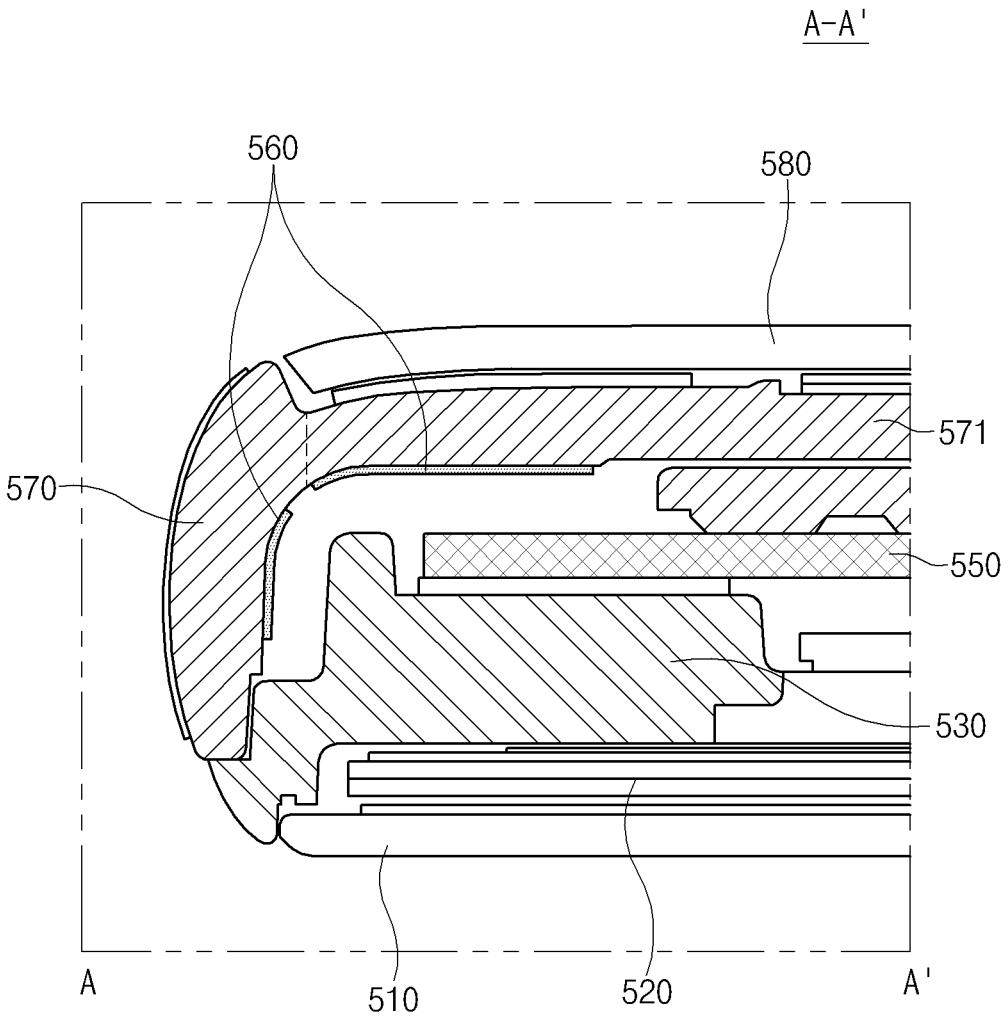
FIG. 5B is a cross-sectional view of an electronic device taken along a line A-A' of FIG. 5A.

FIG. 5A is an exploded perspective view illustrating an antenna radiator positioned in an electronic device, according to an embodiment. FIG. 5B is a cross-sectional view of an electronic device taken along a line A-A' of FIG. 5A.

Referring to FIGS. 5A and 5B, an antenna radiator 560 (e.g., antenna radiator 460) may be interposed between a second support member 571 (e.g., the second support member 471) and a first support member 530 (e.g., the first support member 430).

According to an embodiment, the antenna radiator 560 may be attached to one side of the second support member 571 (e.g., the inner side surface of the second support member 571 facing the first support member 530).

According to an embodiment, the antenna radiator 560 may be attached so as to be bent to conform to the surface shape of the object that the antenna radiator 560 is attached to. For example, the antenna radiator 560 may conform to the curve of the connecting portion between the second support member 571 and the side bezel structure 570 (e.g., the side bezel structure 470), as shown in FIG. 5B. At least part of the antenna radiator 560 may be attached to one side of the side bezel structure 570 (e.g., the inner side surface of the side bezel structure 570 facing the first support member 530). At least part of the antenna radiator 560 may be attached to face a printed circuit board 550 (e.g., the printed circuit board 450).

Figure 6A:
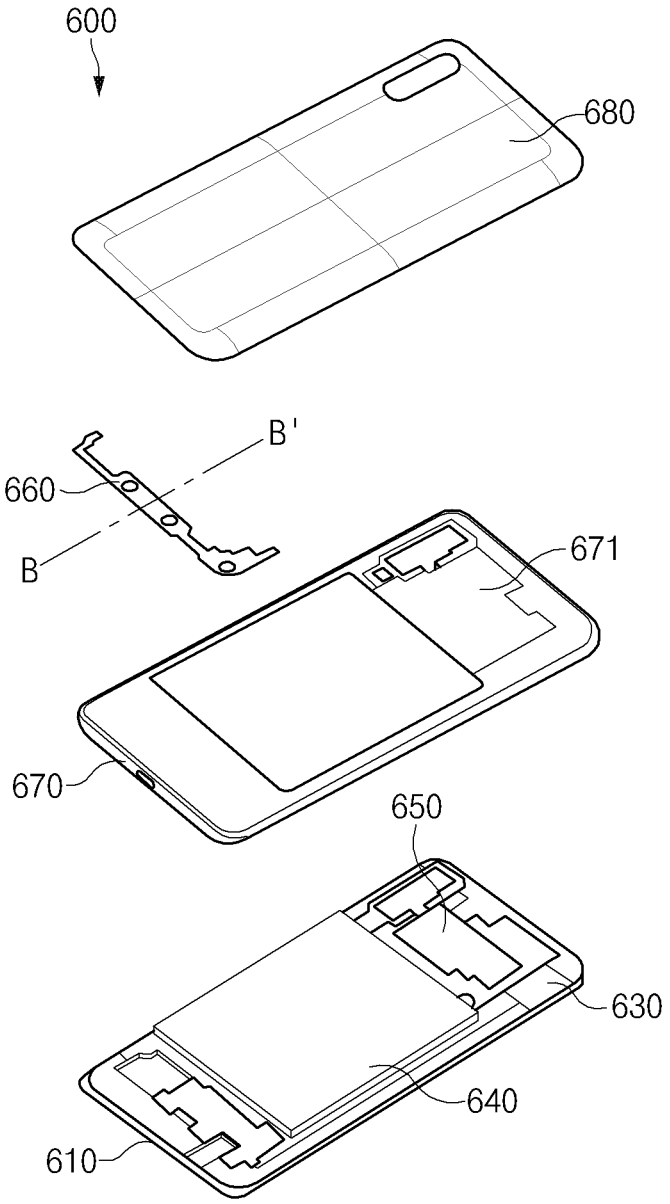
FIG. 6A is an exploded perspective view illustrating an antenna radiator positioned in an electronic device according to an embodiment.
Figure 6B:
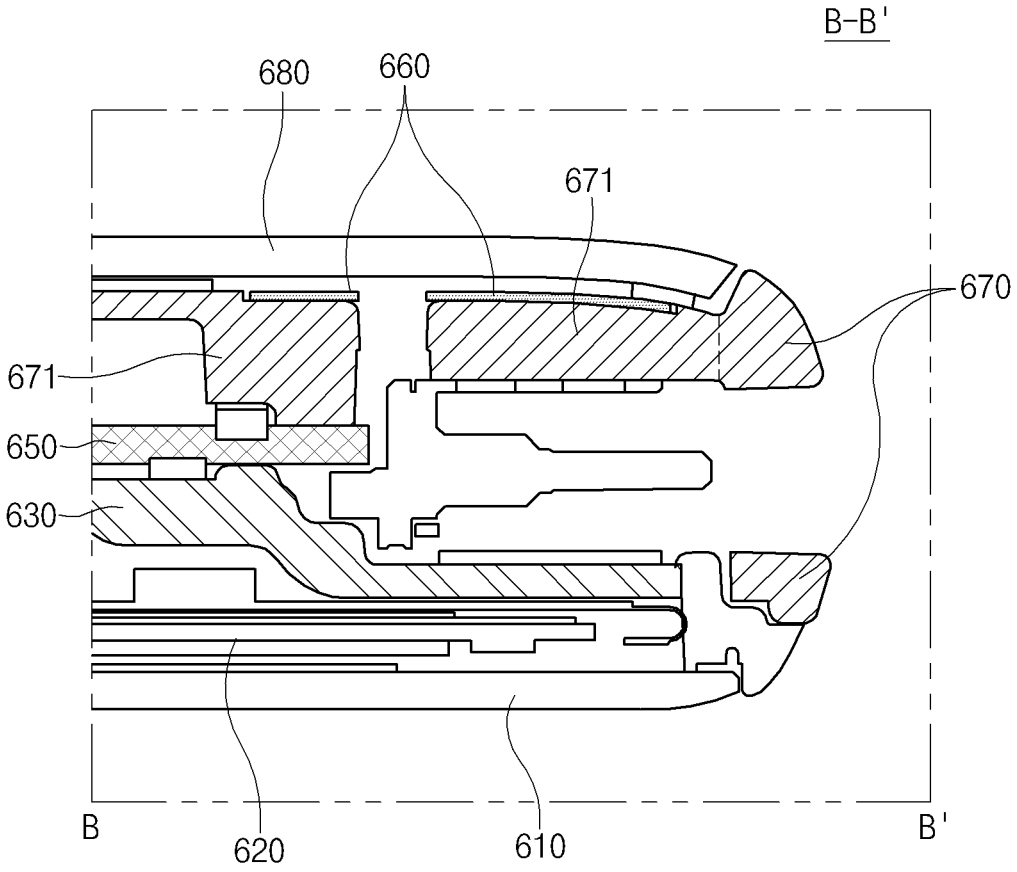
FIG. 6B is a cross-sectional view of an electronic device taken along a line B-B' of FIG. 6A.

FIG. 6A is an exploded perspective view illustrating an antenna radiator positioned in an electronic device, according to an embodiment. FIG. 6B is a cross-sectional view of an electronic device taken along a line B-B' of FIG. 6A.

Referring to FIGS. 6A and 6B, an antenna radiator 660 (e.g., the antenna radiator 460) may be interposed between a rear plate 680 (e.g., the rear plate 480) and a second support member 671 (e.g., the second support member 471 of FIG. 4).

According to an embodiment, the antenna radiator 660 may be attached to one side of the second support member 671 (e.g., the outer side surface of the second support member 671 facing the rear plate 680).

According to an embodiment, the antenna radiator 660 may be attached so as to be bent to conform to the surface shape of the object that the antenna radiator 660 is attached to. For example, the antenna radiator 660 may conform to the curve of the second support member 671, as shown in FIG. 6B. At least part of the antenna radiator 660 may be disposed to face the printed circuit board 650 (e.g., the printed circuit board 450) with the second support member 671 disposed in between.

Figure 7:
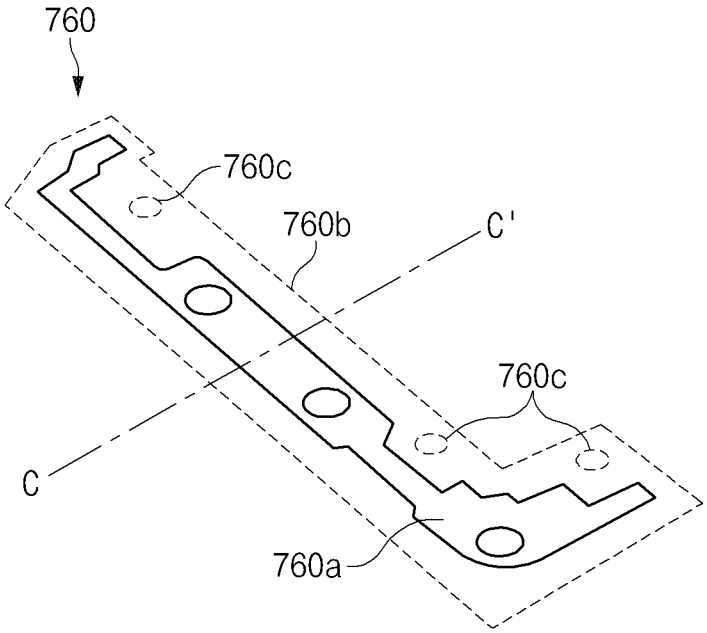
FIG. 7 is a diagram illustrating an example of an antenna radiator unit before being positioned in an electronic device.

FIG. 7 is a diagram illustrating an example of an antenna radiator unit before being positioned in an electronic device. Referring to FIG. 7, according to an embodiment, an antenna radiator 760 (e.g., the antenna radiator 460) may include an antenna pattern part 760*a* and a guide film 760*b*. For example, the antenna pattern part 760*a* may be the portion attached to the electronic device (e.g., an electronic device 400). The guide film 760*b* may provide a guide when the antenna pattern part 760*a* is attached to the electronic device. The guide film 760*b* may have an area larger than the area of the antenna pattern part 760*a*. The guide film 760*b* may further include one or more guide holes 760*c*. The guide holes 760*c* may be formed to correspond to one or more guide members included in the electronic device, and thus may guide the mounting and/or positioning of the antenna pattern part 760*a* when it is attached at a specified location in the electronic device. The guide film 760*b* may be removed after the antenna pattern part 760*a* is attached. In another example, the guide film 760*b* may be omitted.

FIGS. 8A to 11B are diagrams illustrating one or more configurations of an antenna radiator according to various embodiments and are cross-sectional views taken along the line C-C' of FIG. 7. In FIGS. 8A to 11B, the same reference numeral may refer to the same component. In FIGS. 8A to 11B, the antenna radiator 760 may be shown as an antenna radiator unit as it exists before being attached to an electronic device (e.g., the electronic device 400). The thicknesses of the various components (e.g., first adhesive layer 761, second adhesive layer 765, third adhesive layer 766, first conductive fabric layer 762, primer coating layer 768, second conductive fabric layer 767, or polymer compound layer 764) included in the antenna radiator 760 are not limited to the embodiments shown.

Figure 8A:
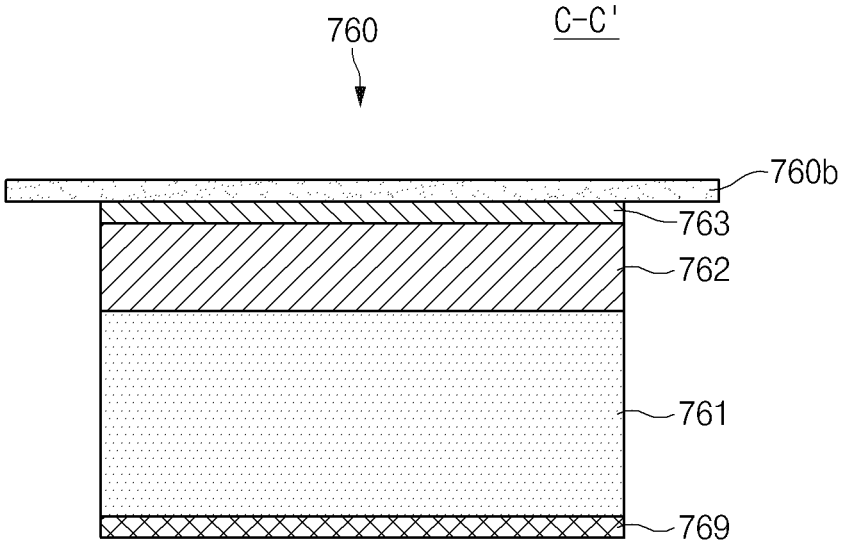
FIG. 8A is a diagram illustrating a configuration of an antenna radiator according to an embodiment and is a cross-sectional view taken along a line C-C' of FIG. 7.
Figure 8B:
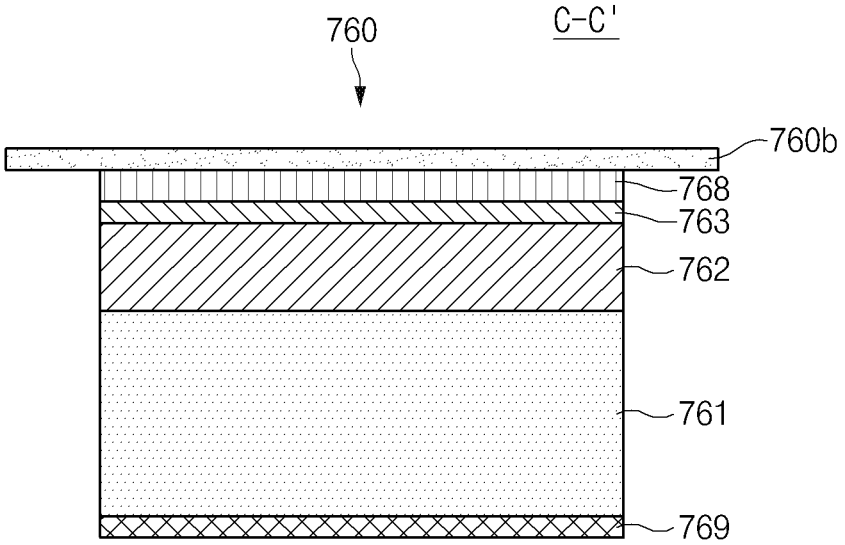
FIG. 8B is a diagram illustrating a configuration of an antenna radiator according to an embodiment and is a cross-sectional view taken along a line C-C' of FIG. 7.

Referring to FIGS. 8A and 8B, the antenna radiator 760 may include one conductive fabric layer.

According to an embodiment, in FIG. 8A, the antenna radiator 760 (e.g., the antenna radiator 460) may include at least one of the first adhesive layer 761 (e.g., pressure sensitive adhesive (PSA)), the first conductive fabric layer 762 (e.g., plated nanofiber), and a conductive coating layer 763 (e.g., anti-tarnish urethane (ATU)). The first conductive fabric layer 762 may be interposed between the conductive coating layer 763 and the first adhesive layer 761. According to an embodiment, the antenna radiator 760 may include the adhesive protective film 769, which protects the first adhesive layer 761, and a guide film 760*b* which may guide the attachment of the antenna radiator 760 to the correct location within the electronic device. The conductive coating layer 763 may be interposed between the first conductive fabric layer 762 and the guide film 760*b*. The first adhesive layer 761 may be interposed between the first conductive fabric layer 762 and the adhesive protective film 769. In an embodiment, the adhesive protective film 769 and/or the guide film 760*b* may be removed when the antenna radiator 760 is attached to the electronic device (e.g., the electronic device 400). In another example, the guide film 760*b* may be omitted.

According to an embodiment, in the design of the first conductive fabric layer 762, consideration may be given to the resistance characteristics required for the antenna radiator 760 to be used in the antenna. For example, the first conductive fabric layer 762 includes a fabric (e.g., nanofiber) and may be formed by plating the fabric with at least one metal. And in a more specific example, the threads included in the fabric included in the first conductive fabric layer 762 may be plated with copper. In another embodiment, the threads included in the fabric included in the first conductive fabric layer 762 may be alternatingly plated with a plurality of metals (e.g. Nickel-copper-nickel). The first conductive fabric layer 762 may have resistance characteristics so that the antenna radiator 760 may be used in an antenna of a specific frequency band (e.g., the frequency band of about 1 GHz or more). For the purpose of performing metal plating that satisfies the required resistance characteristics, the fabric may include air gaps of a specified size or more or be plated with metals of a specific thickness or more.

According to an embodiment, the fabric may not degrade over time, as opposed to flexible printed circuit boards (FPCB). For example, the first conductive fabric layer 762 may not degrade over time as compared to FPCB.

According to an embodiment, the first adhesive layer 761 may attach the antenna radiator 760 to the installation target (e.g., the second support member 471). In an embodiment, the thickness (e.g., about 30 um) of the first adhesive layer 761 may be more than the thickness (e.g., about 15 um) of the first conductive fabric layer 762.

According to an embodiment, the conductive coating layer 763 may prevent the first conductive fabric layer 762 from being corroded. In another example, because the conductive coating layer 763 is electrically conductive, the antenna radiator 760 may not need specific contact pads, and a plurality of contacts for feeding or grounding may be built at any point of the antenna radiator 760.

According to an embodiment, the guide film 760*b* may include one or more guide holes 760*c* for guiding the attachment of the antenna radiator 760 to the electronic device. For example, the guide holes 760*c* may be formed to correspond to the locations of one or more guide members included in the installation target (e.g., the second support member 471). The guide film 760*b* may be removed after the attachment of the antenna radiator 760. Accordingly, compared to the FPCB antenna in which the guide holes are left after installation, the antenna radiator 760 may maintain the same or similar performance while taking up less area. This way, the antenna radiator 760 may have area utilization higher than the area utilization of the FPCB antenna.

According to an embodiment, after the first adhesive layer 761, the first conductive fabric layer 762, and the conductive coating layer 763 are stacked, the antenna radiator 760 may be manufactured in a shape of a specified radiator by using a punching process. Accordingly, the whole attachment area (e.g., 100% of the attachment area) of the antenna radiator 760 may be used for the radiator. Alternatively, the antenna radiator 760 may be manufactured through a molding process or a patterning process. According to an embodiment, the antenna radiator 760 may be manufactured in the shape of the specified radiator through the punching process by using a laser. In this case, referring to FIG. 8A or 9A, at least one of the first adhesive layer 761, the first conductive fabric layer 762, or the polymer compound layer 764 may be manufactured in a specified color. For example, the specified color may be distributed in the region to be punched. The region to be punched may be displayed in the specified color. In addition, the specified color may be a non-transparent color capable of responding well to the laser. The closer the specified color is to black, the better the specified color responds to the laser.

According to an embodiment, referring to FIG. 8B, the antenna radiator 760 may further include a primer coating layer 768 (e.g. a conductive silicon coating or a conductive primer) in addition to the configurations of FIG. 8A. For example, the primer coating layer 768 may be interposed between the conductive coating layer 763 and the guide film 760*b*. When the antenna radiator 760 is interposed between the rear plate 680 and the second support member 671, as shown in FIGS. 6A and 6B, the primer coating layer 768 may prevent the damage to the antenna radiator 760 by the rear plate 680 when the rear plate 680 is removed from the electronic device, which may occur during AS or assembly of the electronic device. According to an embodiment, the primer coating layer 768 may include conductive powder so as to be electrically conductive.

Figure 9A:
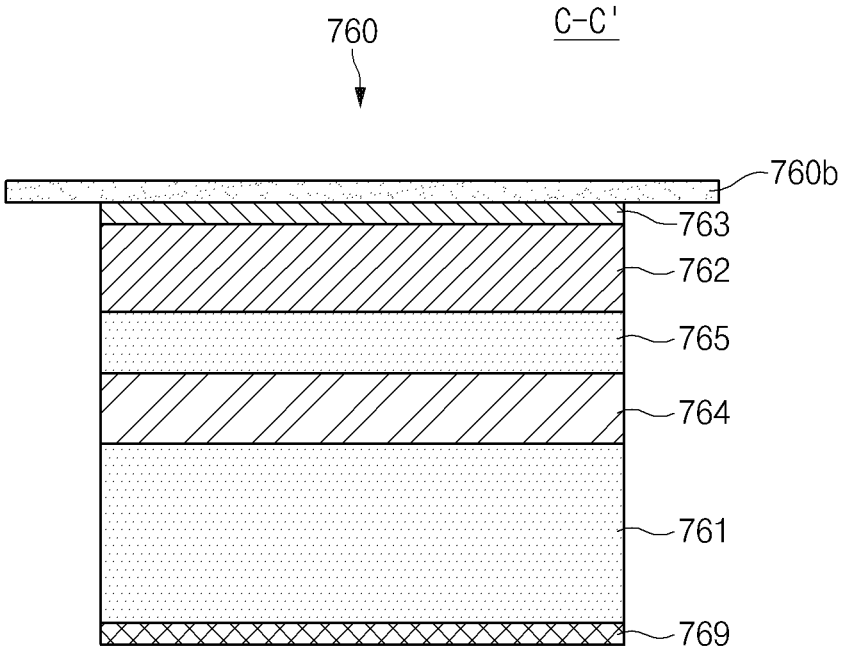
FIG. 9A is a diagram illustrating a configuration of an antenna radiator according to an embodiment and is a cross-sectional view taken along a line C-C' of FIG. 7.
Figure 9B:
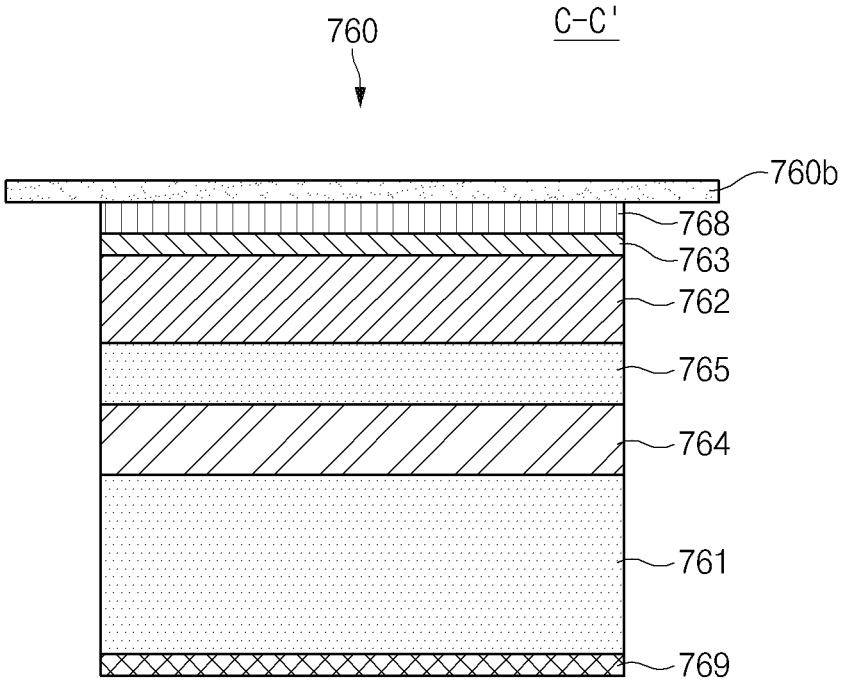
FIG. 9B is a diagram illustrating a configuration of an antenna radiator according to an embodiment and is a cross-sectional view taken along a line C-C' of FIG. 7.

Referring to FIG. 9A or 9B, the antenna radiator 760 may further include a polymer compound layer 764 (e.g., polyethylene terephthalate (PET) or polyimide (PI)) in addition to the configurations shown in FIG. 8A or 8B.

According to an embodiment, in FIG. 9A, the antenna radiator 760 may include at least one of the adhesive protective film 769, the first adhesive layer 761, the polymer compound layer 764, the second adhesive layer 765 (e.g., PSA), the first conductive fabric layer 762, the conductive coating layer 763, and the guide film 760*b*. For example, the first adhesive layer 761 may be interposed between the adhesive protective film 769 and the polymer compound layer 764. The polymer compound layer 764 may be interposed between the first adhesive layer 761 and the second adhesive layer 765. The second adhesive layer 765 may be interposed between the polymer compound layer 764 and the first conductive fabric layer 762. The first conductive fabric layer 762 may be interposed between the second adhesive layer 765 and the conductive coating layer 763. The conductive coating layer 763 may be interposed between the first conductive fabric layer 762 and the guide film 760*b*.

According to an embodiment, the polymer compound layer 764 may protect the antenna radiator 760 from thermal damage. For example, when the polymer compound layer 764 is not present, the first conductive fabric layer 762 may repeatedly expand and contract due to changes in temperature, and thus wrinkles may occur. When wrinkling occurs in the first conductive fabric layer 762, the resonant frequency of antenna radiator 760 may be changed, and the changed frequency may be different from the resonant frequency specified designed for the antenna radiator 760. When the resonant frequency of the antenna radiator 760 is changed, the performance of the antenna including the antenna radiator 760 may degrade. The polymer compound layer 764 may prevent the deformation of the first conductive fabric layer 762 caused by repeated temperature changes, thereby maintaining the performance of the antenna radiator 760.

According to an embodiment, the polymer compound layer 764 may improve the flexibility of the antenna radiator 760. For example, through the polymer compound layer 764, the antenna radiator 760 may be bent into the desired shape and maintain the bent shape. Thus, using the polymer compound layer 764, the antenna radiator 760 may be more easily attached to a curved surface of the installation target (e.g., the second support member 471).

According to an embodiment, the polymer compound layer 764 may prevent the antenna radiator 760 from deforming over time. In another embodiment, the polymer compound layer 764 may increase the tensile strength of the antenna radiator 760.

According to an embodiment, the antenna radiator 760 may include a plurality of adhesive layers (e.g., the first adhesive layer 761 and the second adhesive layer 765). For example, the first adhesive layer 761 may attach the antenna radiator 760 to the installation target. The second adhesive layer 765 may attach the polymer compound layer 764 to the first conductive fabric layer 762. In an embodiment, the thickness (e.g., about 30 um) of the first adhesive layer 761 may be more than the thickness (e.g., about 15 um) of the first conductive fabric layer 762. The thickness (e.g., about 15 um) of the first conductive fabric layer 762 may be more than the thickness (e.g., about 12 um) of the polymer compound layer 764. The thickness (e.g., about 12 um) of the polymer compound layer 764 may be more than the thickness (e.g., about 10 um) of the second adhesive layer 765.

According to an embodiment, referring to FIG. 9B, the antenna radiator 760 may further include the primer coating layer 768 (e.g. a conductive silicon coating or a conductive primer) in addition to the configurations of FIG. 9A. For example, the primer coating layer 768 may be interposed between the conductive coating layer 763 and the guide film 760*b*. The primer coating layer 768 may be the same as or similar as the primer coating layer 768 of FIG. 8B.

Figure 10A:
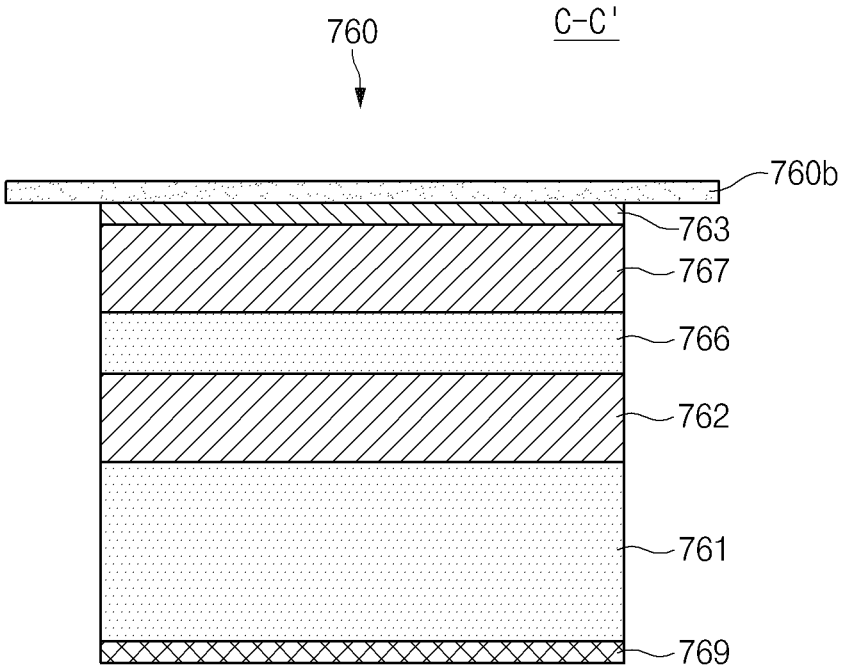
FIG. 10A is a diagram illustrating a configuration of an antenna radiator according to an embodiment and is a cross-sectional view taken along a line C-C' of FIG. 7.
Figure 10B:
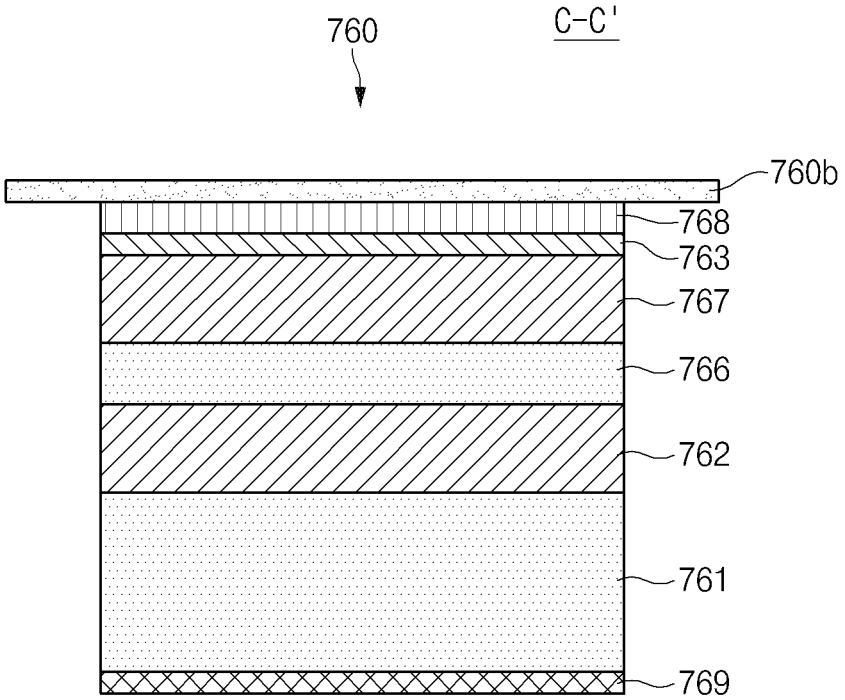
FIG. 10B is a diagram illustrating a configuration of an antenna radiator according to an embodiment and is a cross-sectional view taken along a line C-C' of FIG. 7.

Referring to FIG. 10A or 10B, the antenna radiator 760 may include a plurality of conductive fabric layers (e.g., the first conductive fabric layer 762 and the second conductive fabric layer 767).

According to an embodiment, in FIG. 10A, the antenna radiator 760 may include at least one of the adhesive protective film 769, the first adhesive layer 761, the first conductive fabric layer 762, the third adhesive layer 766 (e.g., conductive PSA), the second conductive fabric layer 767, the conductive coating layer 763, and the guide film 760*b*. For example, the first adhesive layer 761 may be interposed between the adhesive protective film 769 and the first conductive fabric layer 762. The first conductive fabric layer 762 may be interposed between the first adhesive layer 761 and the third adhesive layer 766. The third adhesive layer 766 may be interposed between the first conductive fabric layer 762 and the second conductive fabric layer 767. The second conductive fabric layer 767 may be interposed between the third adhesive layer 766 and the conductive coating layer 763. The conductive coating layer 763 may be interposed between the second conductive fabric layer 767 and the guide film 760*b*.

According to an embodiment, the antenna radiator 760 may include a plurality of adhesive layers (e.g., the first adhesive layer 761 and the third adhesive layer 766). For example, the first adhesive layer 761 may attach the antenna radiator 760 to the installation target. The third adhesive layer 766 may attach the first conductive fabric layer 762 to the second conductive fabric layer 767. In an embodiment, the thickness (e.g., about 30 um) of the first adhesive layer 761 may be more than the thickness (e.g., about 15 um) of the first conductive fabric layer 762 or the second conductive fabric layer 767. The thickness (e.g., about 15 um) of the first conductive fabric layer 762 or the second conductive fabric layer 767 may be more than the thickness (e.g., about 10 um) of the third adhesive layer 766.

According to certain embodiments, the thicknesses of the first conductive fabric layer 762 and the second conductive fabric layer 767 may be the same or different.

According to an embodiment, the third adhesive layer 766 may have conductive characteristics. For example, the third adhesive layer 766 may be formed by mixing conductive powder (e.g., metal powder) with an adhesive member (e.g., PSA). The third adhesive layer 766 may electrically connect the first conductive fabric layer 762 to the second conductive fabric layer 767.

According to an embodiment, the antenna radiator 760 includes a plurality of conductive fabric layers, thereby improving the resistance characteristics of the antenna radiator 760. For example, the antenna radiator 760 may include the first conductive fabric layer 762 and the second conductive fabric layer 767. The first conductive fabric layer 762 and the second conductive fabric layer 767 may be electrically connected via the third adhesive layer 766. As illustrated in FIGS. 8A to 9B, the antenna radiator 760, in which a plurality of conductive fabric layers (e.g., the first conductive fabric layer 762 and the second conductive fabric layer 767) are used, may have improved resistance characteristic (e.g. resistance is reduced), as compared with the case where a single conductive fabric layer (e.g., the first conductive fabric layer 762) is used. For example, when the first conductive fabric layer 762 and the second conductive fabric layer 767 are used together, the antenna radiator 760 may have sufficient resistance characteristic so that it can be used at a frequency band of about 500 MHz to about 1 GHz, which is lower than the frequency band of the antenna radiator 760 of FIGS. 8A to 9B.

According to an embodiment, referring to FIG. 10B, the antenna radiator 760 may further include the primer coating layer 768 (e.g. a conductive silicon coating or a conductive primer) in addition to the configurations of FIG. 10A. For example, the primer coating layer 768 may be interposed between the conductive coating layer 763 and the guide film 760*b*. The primer coating layer 768 may be the same or be similar to the primer coating layer 768 of FIG. 8B.

Figure 11A:
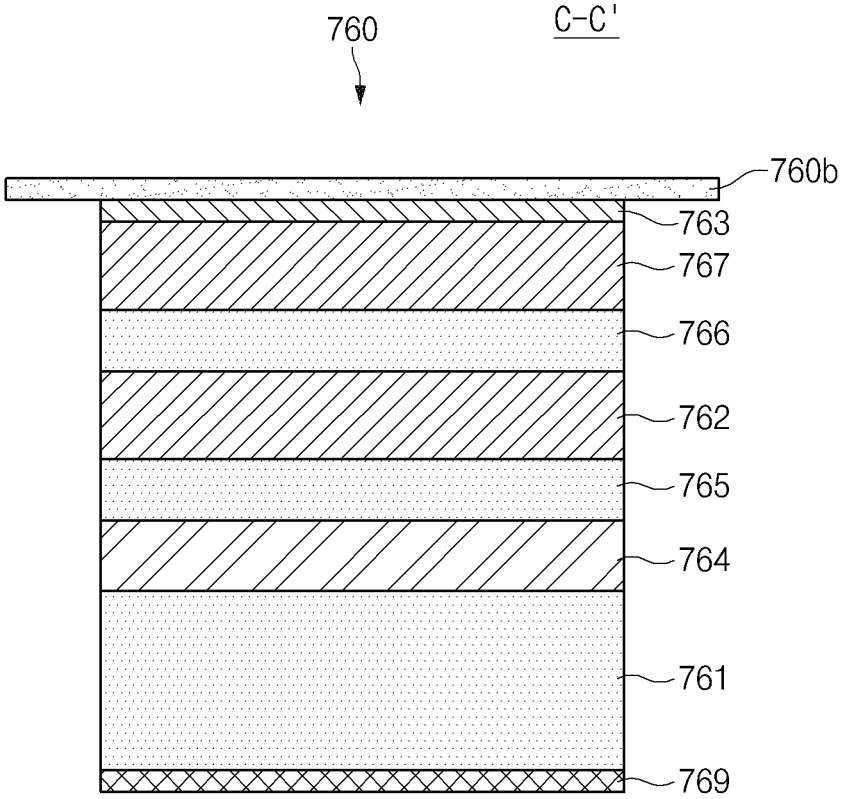
FIG. 11A is a diagram illustrating a configuration of an antenna radiator according to an embodiment and is a cross-sectional view taken along a line C-C' of FIG. 7.
Figure 11B:
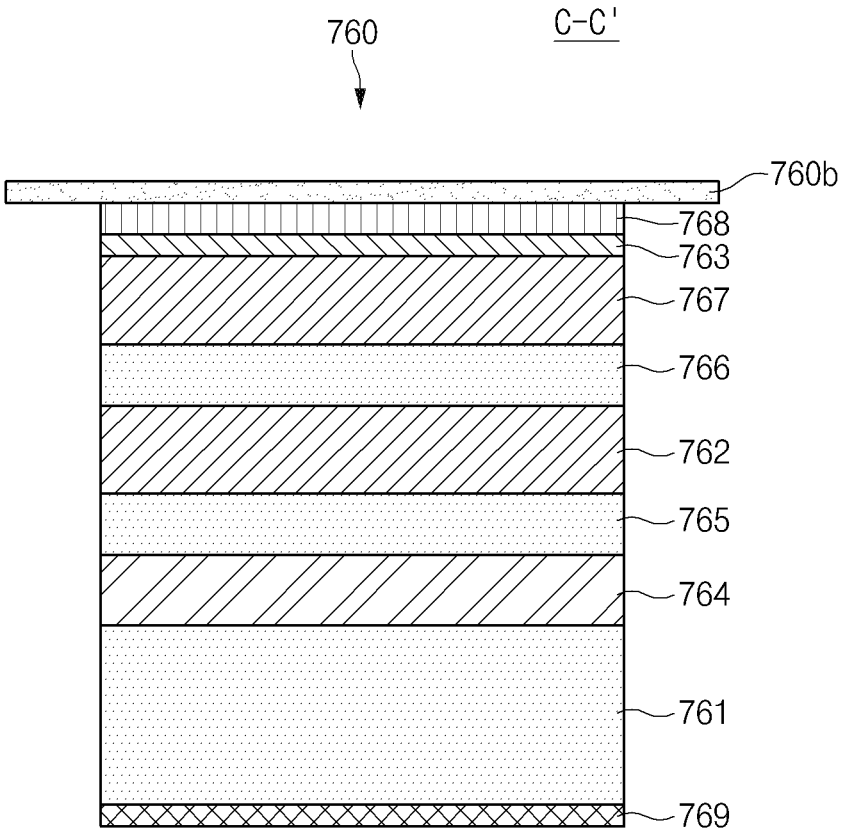
FIG. 11B is a diagram illustrating a configuration of an antenna radiator according to an embodiment and is a cross-sectional view taken along a line C-C' of FIG. 7.

Referring to FIG. 11A or 11B, the antenna radiator 760 may include all of the components described in FIGS. 8A to 10B.

According to an embodiment, in FIG. 11A, the antenna radiator 760 may include at least one of the adhesive protective film 769, the first adhesive layer 761, the polymer compound layer 764, the second adhesive layer 765, the first conductive fabric layer 762, the third adhesive layer 766, the second conductive fabric layer 767, the conductive coating layer 763, and the guide film 760*b*. For example, the first adhesive layer 761 may be interposed between the adhesive protective film 769 and the polymer compound layer 764. The polymer compound layer 764 may be interposed between the first adhesive layer 761 and the second adhesive layer 765. The second adhesive layer 765 may be interposed between the polymer compound layer 764 and the first conductive fabric layer 762. The first conductive fabric layer 762 may be interposed between the second adhesive layer 765 and the third adhesive layer 766. The third adhesive layer 766 may be interposed between the first conductive fabric layer 762 and the second conductive fabric layer 767. The second conductive fabric layer 767 may be interposed between the third adhesive layer 766 and the conductive coating layer 763. The conductive coating layer 763 may be interposed between the second conductive fabric layer 767 and the guide film 760*b*.

According to an embodiment, referring to FIG. 11B, the antenna radiator 760 may further include the primer coating layer 768 (e.g. a conductive silicon coating or a conductive primer) in the configurations of FIG. 11A. For example, the primer coating layer 768 may be interposed between the conductive coating layer 763 and the guide film 760*b*.

According to an embodiment, the characteristics of the adhesive protective film 769, the first adhesive layer 761, the polymer compound layer 764, the second adhesive layer 765, the first conductive fabric layer 762, the third adhesive layer 766, the second conductive fabric layer 767, the conductive coating layer 763, the primer coating layer 768, or the guide film 760*b* illustrated in FIG. 11A or 11B are identical or similar to the characteristics of the adhesive protective film 769, the first adhesive layer 761, the polymer compound layer 764, the second adhesive layer 765, the first conductive fabric layer 762, the third adhesive layer 766, the second conductive fabric layer 767, the conductive coating layer 763, the primer coating layer 768, or the guide film 760*b* illustrated in FIGS. 8A to 10B, and thus, additional description will be omitted to avoid redundancy.

According to an embodiment, in FIGS. 8A to 11B, the antenna radiator 760 may be formed through a punching process after at least one of the first adhesive layer 761, the polymer compound layer 764, the second adhesive layer 765, the first conductive fabric layer 762, the third adhesive layer 766, the second conductive fabric layer 767, the conductive coating layer 763, or the primer coating layer 768 are stacked. For example, after punching, in the single antenna radiator 760, the first adhesive layer 761, the polymer compound layer 764, the second adhesive layer 765, the first conductive fabric layer 762, the third adhesive layer 766, the second conductive fabric layer 767, the conductive coating layer 763, and the primer coating layer 768 may have substantially the same shape and/or size. According to an embodiment, the shapes and/or sizes of at least the polymer compound layer 764, the first conductive fabric layer 762, and the second conductive fabric layer 767 may be identical to the shape of the outline of the antenna radiator 760.

Figure 12A:
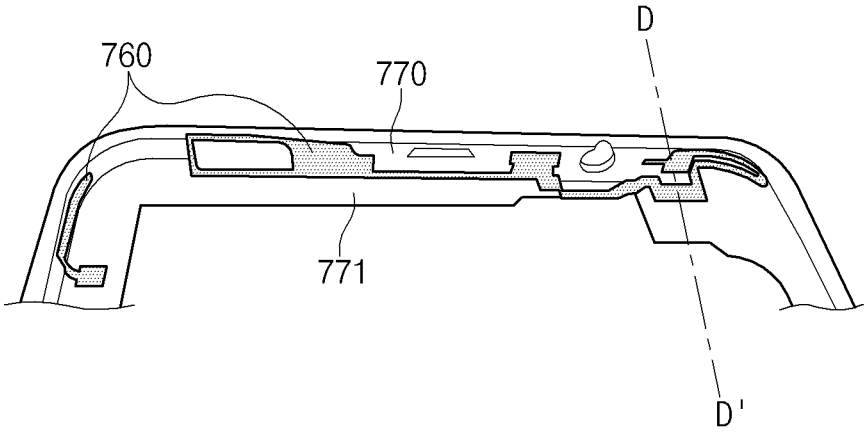
FIG. 12A is a view illustrating an antenna radiator attached to a support member according to an embodiment.
Figure 12B:
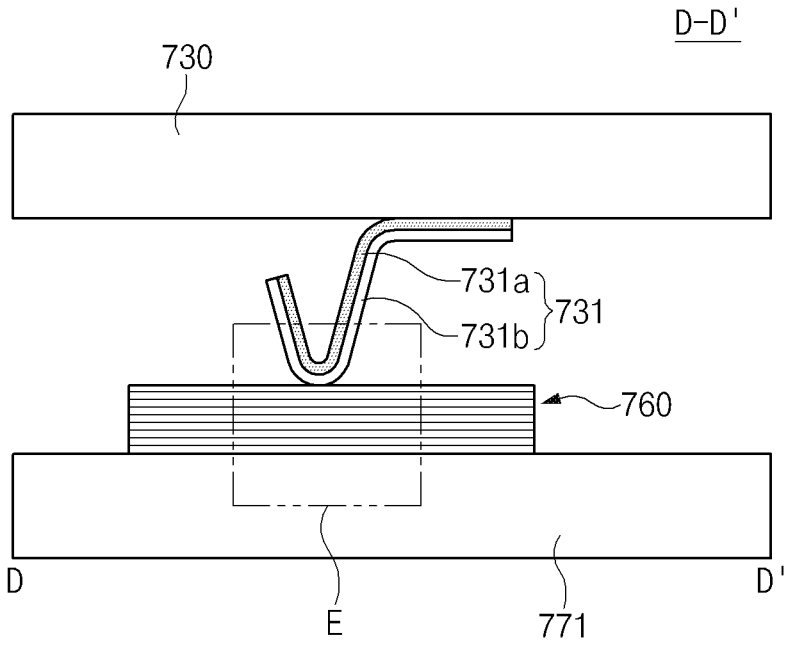
FIG. 12B is a sectional view taken along a line D-D' of FIG. 12A.
Figure 12C:
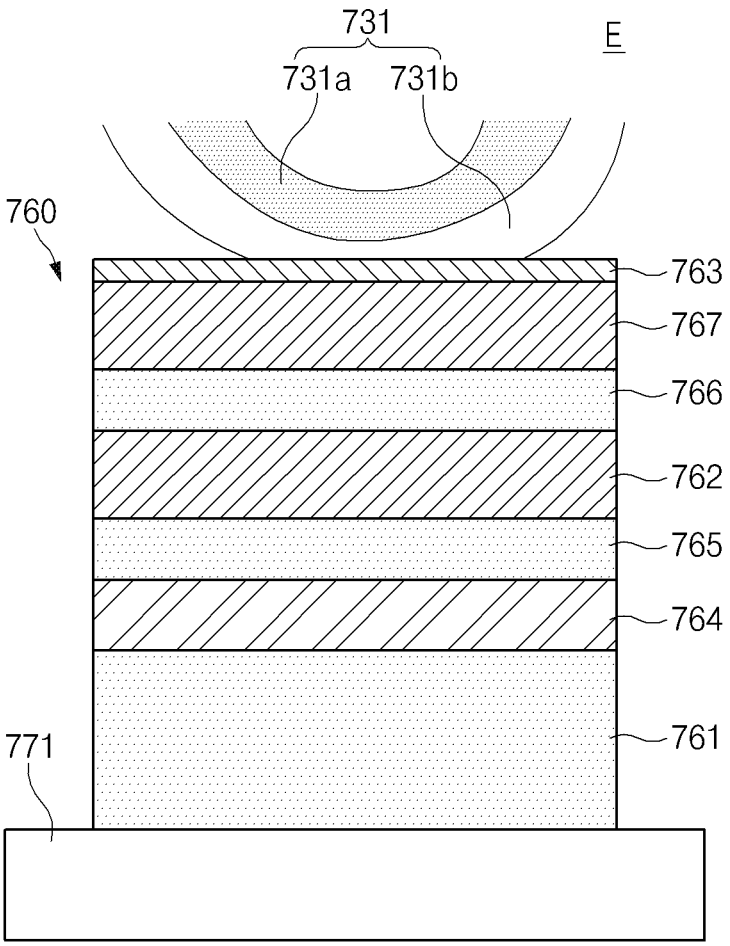
FIG. 12C is a cross-sectional view obtained by enlarging portion 'E' of FIG. 12B.

FIG. 12A is a view illustrating an antenna radiator attached to a support member, according to an embodiment. FIG. 12B is a sectional view taken along a line D-D' of FIG. 12A. FIG. 12B shows a contact point for feeding or grounding. FIG. 12C is a cross-sectional view obtained by enlarging portion 'E' of FIG. 12B.

Referring to FIGS. 12A to 12C, the antenna radiator 760 (e.g., antenna radiator 460) may be attached to the second support member 771 (e.g., the second support member 471) via the first adhesive layer 761. In another example, the antenna radiator 760 may be attached to the side bezel structure 770 (e.g., the side bezel structure 470) through the first adhesive layer 761. The feed part or ground part of the printed circuit board 730 (e.g., the printed circuit board 450) may be connected to a connection member 731 (e.g., C-clip). A portion of the connection member 731 may be connected to contact point 'E' of the antenna radiator 760. An exemplary embodiment is shown in FIG. 12C where the antenna radiator 760 includes the polymer compound layer 764 and the plurality of conductive fabric layers 762 and 767. However the instant disclosure is not limited to this particular embodiment. Any of the antenna radiator 760 described with reference to FIGS. 8A through 11B may be connected to a feed part or a ground part via the connection member 731.

According to an embodiment, the contact point 'E' of the antenna radiator 760 may be positioned at any point (or at all points) on the antenna radiator 760. For example, the entirety of the conductive coating layer 763 may transmit electrical signals to the second conductive fabric layer 767 (or the first conductive fabric layer 762 in the case of FIGS. 8A to 9B). The second conductive fabric layer 767 may deliver the electrical signal to the first conductive fabric layer 762 via the third adhesive layer 766.

According to an embodiment, the second conductive fabric layer 767 (or the first conductive fabric layer 762 in the case of FIGS. 8A to 9B) may prevent the corrosion (e.g. galvanic corrosion) of the antenna radiator 760 at the contact point 'E'. For example, the connection member 731 may include a metal portion 731*a* and a plating portion 731*b*. The second conductive fabric layer 767 (or the first conductive fabric layer 762 in the case of FIGS. 8A to 9B) may be plated with nickel. The potential difference between the plating portion 731*b* and the second conductive fabric layer 767 (or the first conductive fabric layer 762 in the case of FIGS. 8A to 9B) occurs below a specific voltage (e.g., 300 mV), thereby preventing the corrosion of the antenna radiator 760.

According to an embodiment, an electronic device (e.g., the electronic device (101, 200, 400)) may include a housing (e.g., the housing 210), a first plate (e.g., the front plate (202, 410)) positioned on a front surface of the housing, a second plate (e.g., the rear plate (211, 480)) positioned on a rear surface of the housing, an antenna radiator (e.g., the antenna radiator (460, 560, 660, 760)) interposed between the first plate and the second plate, and a wireless communication circuit (e.g., the wireless communication module 192) connected to the antenna radiator and processing a signal in a specific frequency band. The antenna radiator may include at least one conductive fabric layer (e.g., the first conductive fabric layer 762 or the second conductive fabric layer 767) having a resistance characteristic suitable for transmitting or receiving the signal in the specific frequency band, and the at least one conductive fabric layer may include a fabric (e.g., nanofiber) that is plated with at least one metal (e.g., copper or nickel).

According to an embodiment, threads included in the fabric may be alternatingly plated with copper and nickel.

According to an embodiment, the antenna radiator may include a conductive coating layer (e.g., the conductive coating layer 763) configured to prevent corrosion of the at least one conductive fabric layer and transmit a signal from the wireless communication circuit to the at least one conductive fabric layer and a first adhesive layer (e.g., the first adhesive layer 761) configured to attach the antenna radiator to an installation target within the housing. The at least one conductive fabric layer may be interposed between the conductive coating layer and the first adhesive layer.

According to an embodiment, the antenna radiator may further include a primer coating layer (e.g., the primer coating layer 768) configured to prevent damage to the antenna radiator when an object contacting a top surface of the antenna radiator is detached, and the conductive coating layer may be interposed between the primer coating layer and the at least one conductive fabric layer.

According to an embodiment, the primer coating layer may include conductive powder so as to be conductive to transmit the signal from the wireless communication circuit, to the conductive coating layer.

According to an embodiment, the antenna radiator may further include a second adhesive layer (e.g., the second adhesive layer 765) interposed between the first adhesive layer and the conductive fabric layer and a polymer compound layer (e.g., the polymer compound layer 764) interposed between the first adhesive layer and the second adhesive layer.

According to an embodiment, the at least one conductive fabric layer may include a first conductive fabric layer (e.g., the first conductive fabric layer 762) and a second conductive fabric layer (e.g., the second conductive fabric layer 767). The antenna radiator may further include a first adhesive layer configured to attach the antenna radiator to an installation target within the housing, a conductive coating layer configured to transmit a signal from the wireless communication circuit to the at least one conductive fabric layer and a second adhesive layer interposed between the first conductive fabric layer and the second conductive fabric layer. The second conductive fabric layer may be interposed between the conductive coating layer and the second adhesive layer.

According to an embodiment, the antenna radiator may further include a primer coating layer configured to prevent damage to the antenna radiator when an object contacting a top surface of the antenna radiator is detached, and the conductive coating layer may be interposed between the primer coating layer and the second conductive fabric layer.

According to an embodiment, the antenna radiator may further include a third adhesive layer interposed between the first conductive fabric layer and the first adhesive layer and a polymer compound layer interposed between the first adhesive layer and the third adhesive layer.

According to an embodiment, the second adhesive layer may include conductive powder.

According to an embodiment, the shape of the first conductive fabric layer and/or the shape of the second conductive fabric layer may be the same as the shape of an outline of the antenna radiator.

According to an embodiment, the electronic device may further include a bracket (e.g., the first support member 430) interposed between the first plate and the second plate and a rear case (e.g., the second support member 471) interposed between the bracket and the second plate. The antenna radiator may be attached to one side of the rear case facing the bracket.

According to an embodiment, the electronic device may further include a bracket interposed between the first plate and the second plate and a rear case interposed between the bracket and the second plate. The antenna radiator may be attached to one side of the rear case facing the second plate.

According to an embodiment, the electronic device may further include a printed circuit board (e.g., the printed circuit board 450) on which the wireless communication circuit is mounted, a feed part disposed on the printed circuit board and connected to the wireless communication circuit, a ground part connected to a ground region included in the printed circuit board, and at least one connection member (e.g., the connection member 731 or C-clip) connecting a point on the antenna radiator to the feed part or the ground part.

According to an embodiment, an antenna radiator may include at least one conductive fabric layer including a fabric that is plated with at least one metal and a conductive coating layer stacked on the at least one conductive fabric layer, and configured to prevent corrosion of the at least one conductive fabric layer and transmit an electrical signal external to the antenna radiator to the at least one conductive fabric layer.

According to an embodiment, the antenna radiator may further include a polymer compound layer stacked under the at least one conductive fabric layer.

According to an embodiment, the antenna radiator may further include a primer coating layer stacked on the conductive coating layer and configured to prevent damage to the antenna radiator when an object contacting a top surface of the antenna radiator is detached. The primer coating layer may include conductive powder so as to be conductive to transmit the electrical signal to the conductive coating layer.

According to an embodiment, the at least one conductive fabric layer may include a first conductive fabric layer and a second conductive fabric layer stacked on the first conductive fabric layer. The antenna radiator may further include a first adhesive layer stacked under the polymer compound layer, a second adhesive layer interposed between the polymer compound layer and the first conductive fabric layer, and a third adhesive layer interposed between the first conductive fabric layer and the second conductive fabric layer. The third adhesive layer may include conductive powder so as to be conductive to electrically connect the first conductive fabric layer to the second conductive fabric layer.

According to an embodiment, the first conductive fabric layer and the second conductive fabric layer may have the same thickness.

According to an embodiment, the first conductive fabric layer and the second conductive fabric layer may have different thicknesses.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to one or more embodiments disclosed in the specification, it is possible to maintain performance and prevent degradation over time of an antenna that is attached to a curved portion of an electronic device. This may be done by using fabric.

According to one or more embodiments disclosed in the specification, the whole antenna attachment area may be used as the antenna pattern, when the antenna radiator is made with fabric.

In addition, a variety of effects and advantages directly or indirectly understood through the disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing;

a first plate positioned on a front surface of the housing;

a second plate positioned on a rear surface of the housing;

an antenna radiator interposed between the first plate and the second plate; and a wireless communication circuit connected to the antenna radiator and configured to process a signal in a specific frequency band, wherein the antenna radiator includes at least one conductive fabric layer having a resistance characteristic suitable for transmitting or receiving the signal in the specific frequency band, and wherein the at least one conductive fabric layer includes a fabric that is plated with at least one metal.

2. The electronic device of claim 1, wherein threads included in the fabric are alternatingly plated with copper and nickel.

3. The electronic device of claim 1, wherein the antenna radiator further comprises:

a conductive coating layer configured to prevent corrosion of the at least one conductive fabric layer and transmit the signal in the specific frequency band to the at least one conductive fabric layer; and a first adhesive layer configured to attach the antenna radiator to an installation target within the housing, wherein the at least one conductive fabric layer is interposed between the conductive coating layer and the first adhesive layer.

4. The electronic device of claim 3, wherein the antenna radiator further comprises:

a primer coating layer configured to prevent damage to the antenna radiator when an object contacting a top surface of the antenna radiator is detached, and wherein the conductive coating layer is interposed between the primer coating layer and the at least one conductive fabric layer.

5. The electronic device of claim 4, wherein the primer coating layer includes conductive powder so as to be conductive to transmit the signal in the specific frequency band to the conductive coating layer.

6. The electronic device of claim 3, wherein the antenna radiator further comprises:

a second adhesive layer interposed between the first adhesive layer and the conductive fabric layer; and a polymer compound layer interposed between the first adhesive layer and the second adhesive layer.

7. The electronic device of claim 1, wherein the at least one conductive fabric layer further comprises a first conductive fabric layer and a second conductive fabric layer, wherein the antenna radiator further comprises:

a first adhesive layer configured to attach the antenna radiator to an installation target within the housing;

a conductive coating layer configured to transmit the signal in the specific frequency band to the at least one conductive fabric layer; and a second adhesive layer interposed between the first conductive fabric layer and the second conductive fabric layer, and wherein the second conductive fabric layer is interposed between the conductive coating layer and the second adhesive layer.

8. The electronic device of claim 7, wherein the antenna radiator further comprises a primer coating layer configured to prevent damage to the antenna radiator when an object contacting a top surface of the antenna radiator is detached, and wherein the conductive coating layer is interposed between the primer coating layer and the second conductive fabric layer.

9. The electronic device of claim 7, wherein the antenna radiator further comprises:

a third adhesive layer interposed between the first conductive fabric layer and the first adhesive layer; and a polymer compound layer interposed between the first adhesive layer and the third adhesive layer.

10. The electronic device of claim 7, wherein the second adhesive layer further comprises conductive powder.

11. The electronic device of claim 7, wherein a shape of the first conductive fabric layer and/or a shape of the second conductive fabric layer is same as a shape of an outline of the antenna radiator.

12. The electronic device of claim 1, further comprising:

a bracket interposed between the first plate and the second plate; and a rear case interposed between the bracket and the second plate, wherein the antenna radiator is attached to one side of the rear case facing the bracket.

13. The electronic device of claim 1, further comprising:

a bracket interposed between the first plate and the second plate; and a rear case interposed between the bracket and the second plate, wherein the antenna radiator is attached to one side of the rear case facing the second plate.

14. The electronic device of claim 1, further comprising:

a printed circuit board on which the wireless communication circuit is mounted;

a feed part disposed on the printed circuit board and connected to the wireless communication circuit;

a ground part connected to a ground region included in the printed circuit board; and at least one connection member connecting a point on the antenna radiator to the feed part or the ground part.

15. An antenna radiator comprising:

at least one conductive fabric layer including a fabric that is plated with at least one metal; and a conductive coating layer stacked on the at least one conductive fabric layer, and configured to prevent corrosion of the at least one conductive fabric layer and transmit an electrical signal external to the antenna radiator to the at least one conductive fabric layer.

16. The antenna radiator of claim 15, further comprising:

a polymer compound layer stacked under the at least one conductive fabric layer.

17. The antenna radiator of claim 16, further comprising:

a primer coating layer stacked on the conductive coating layer and configured to prevent damage to the antenna radiator when an object contacting a top surface of the antenna radiator is detached, wherein the primer coating layer includes conductive powder so as to be conductive to transmit the electrical signal to the conductive coating layer.

18. The antenna radiator of claim 17, wherein the at least one conductive fabric layer further comprises a first conductive fabric layer and a second conductive fabric layer stacked on the first conductive fabric layer, wherein the antenna radiator further comprises:

a first adhesive layer stacked under the polymer compound layer;

a second adhesive layer interposed between the polymer compound layer and the first conductive fabric layer; and a third adhesive layer interposed between the first conductive fabric layer and the second conductive fabric layer, and wherein the third adhesive layer includes conductive powder so as to be conductive to electrically connect the first conductive fabric layer to the second conductive fabric layer.

19. The antenna radiator of claim 18, wherein the first conductive fabric layer and the second conductive fabric layer have a same thickness.

20. The antenna radiator of claim 18, wherein the first conductive fabric layer and the second conductive fabric layer have different thicknesses.

* * * * *